US009376784B2

(12) United States Patent
O'Donnell

(10) Patent No.: US 9,376,784 B2
(45) Date of Patent: Jun. 28, 2016

(54) CONTROL SYSTEM FOR DUAL BOOM MACHINE

(71) Applicant: Caterpillar Inc., Peoria, IL (US)

(72) Inventor: Timothy Michael O'Donnell, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 258 days.

(21) Appl. No.: 13/853,474

(22) Filed: Mar. 29, 2013

(65) Prior Publication Data

US 2014/0290102 A1 Oct. 2, 2014

(51) Int. Cl.

| | |
|---|---|
| ***E02F 3/96*** | (2006.01) |
| ***E02F 3/42*** | (2006.01) |
| ***E02F 3/43*** | (2006.01) |
| ***E02F 9/20*** | (2006.01) |

(52) U.S. Cl.

CPC ..... *E02F 3/435* (2013.01); *E02F 3/964* (2013.01); *E02F 3/965* (2013.01); *E02F 3/966* (2013.01); *E02F 9/2012* (2013.01); *Y10T 74/20012* (2015.01)

(58) Field of Classification Search

CPC ..... E02F 9/265; E02F 9/24; E02F 3/961; E02F 3/425; E02F 3/435; E04G 23/08; F01B 25/10; G06F 19/00

USPC ..... 701/50; 414/687

See application file for complete search history.

(56) References Cited

U.S. PATENT DOCUMENTS

| | | | | |
|---|---|---|---|---|
| 4,825,960 | A * | 5/1989 | Krone | 173/51 |
| 4,960,359 | A * | 10/1990 | Lovitt, Jr. | 414/686 |
| 6,209,675 | B1 * | 4/2001 | Hayashi et al. | 180/307 |
| 6,233,511 | B1 * | 5/2001 | Berger et al. | 701/50 |
| 2005/0066655 | A1 * | 3/2005 | Aarestad et al. | 60/413 |
| 2008/0156761 | A1 * | 7/2008 | Schneider et al. | 212/273 |
| 2011/0150615 | A1 | 6/2011 | Ishii | |
| 2012/0255293 | A1 * | 10/2012 | Reedy et al. | 60/459 |
| 2013/0268165 | A1 * | 10/2013 | Hashima et al. | 701/50 |

* cited by examiner

*Primary Examiner* — Calvin Cheung
*Assistant Examiner* — Martin Weeks
(74) *Attorney, Agent, or Firm* — Finnegan, Henderson, Farabow, Garrett & Dunner, LLP

(57) ABSTRACT

A control system is disclosed for use with a machine. The control system may have a first linkage arrangement, a first actuator, a first interface device, and a first control element. The control system may also have a second linkage arrangement, a second actuator, a second interface device, and a second control element. The control system may further have an input device selectively activated to generate a mode signal, and a controller. The controller may be configured to selectively generate commands directed to the first control element based on only the first actuator signals, and to selectively generate commands directed to the second control element based on only the second actuator signals. The controller may also be configured to selectively generate commands directed to both of the first and second control elements based on only the first actuator signals an in response to the mode signal.

20 Claims, 3 Drawing Sheets

CONTROL SYSTEM FOR DUAL BOOM MACHINE

TECHNICAL FIELD

The present disclosure relates generally to a control system and, more particularly, to a control system for a machine having dual booms.

BACKGROUND

An excavator is a well-known construction machine having a mobile undercarriage and an upper swing body pivotally connected to the undercarriage. Mechanical linkage is connected to the upper swing body that is movable by hydraulic cylinders to raise, lower, and curl a work tool. The mechanical linkage typically includes a boom pivotally connected at one end to the upper swing body, a stick or arm pivotally connected to a second end of the boom, and the work tool connected at a distal end of the stick. A pair of boom cylinders raises and lowers the boom, while a single stick cylinder pivots the stick relative to the boom. An additional tool cylinder is functional to curl the tool relative to the stick. Many different tools can be connected to the distal end of the stick and movable by the tool actuator, depending on the application of the excavator. These tools can include, among others, a bucket, a grapple, a shear, a hammer, a drill, a vibratory compactor, an auger, a saw, and a pulverizer.

In some applications, it may be desirable to use two or more different tools to accomplish a particular task. For example, in demolition applications, it may be helpful to use both a hammer and a bucket or a grapple and a shear. In these applications, either two machines must be placed together to complete the task (each having a different tool), or the tool of a particular machine must be periodically exchanged with another tool. Both of these solutions can be expensive, inefficient, and/or time consuming.

An alternative solution is disclosed in U.S. Patent Publication 2011/0150615 of Ishii that published on Jun. 23, 2011 ("the '615 publication"). In particular, the '615 publication discloses an excavator having two booms, two arms, and two work tools. Each linkage arrangement of boom, arm, and tool is pivotally connected to the upper structure of the excavator and controllable by a separate operator control device. Each of the two linkage arrangements has a weight and a power that is about one-half of the weight and the power of a conventional single linkage arrangement.

Although the dual linkage arrangement of the '615 publication may improve efficiency somewhat, it may still be problematic. In particular, the machine of the '615 publication may no longer be useful in applications that require the full power of the single linkage arrangement to perform a single operation. In addition, the dual linkage arrangement may suffer from instabilities during particular operations (e.g., during hoisting).

The disclosed control system is directed to overcoming one or more of the problems set forth above and/or other problems of the prior art.

SUMMARY

One aspect of the present disclosure is directed to a control system. The control system may include a first linkage arrangement, and a first actuator configured to move the first linkage arrangement. The control system may also include a first interface device configured to generate first actuator signals indicative of operator desired movements of the first actuator, and a first control element associated with the first actuator. The control system may further include a second linkage arrangement, and a second actuator configured to move the second linkage arrangement. The control system may additionally have a second interface device configured to generate second actuator signals indicative of operator desired movements of the second actuator, and a second control element associated with the second actuator. The control system may also include an input device selectively activated by the operator to generate a mode signal indicative of a desire for the first actuator and the second actuator to be controlled cooperatively, and a controller in communication with the first interface device, the first control element, the second interface device, the second control element, and the input device. The controller may be configured to selectively generate commands directed to the first control element based on only the first actuator signals, and to selectively generate commands directed to the second control element based on only the second actuator signals. The controller may also be configured to selectively generate commands directed to both of the first and second control elements based on only the first actuator signals and in response to the mode signal.

A second aspect of the present disclosure is directed to a method of controlling a machine having first and second linkage arrangements. The method may include receiving a first signal from a first interface device indicative of desired movements of the first linkage arrangement, and selectively generating commands causing movements of only the first linkage arrangement based on only the first actuator signals. The method may also include receiving a second signal from a second interface device indicative of desired movements of the second linkage arrangement, and selectively generating commands causing movements of only the second linkage arrangement based on only the second actuator signals. The method may further include receiving input indicative of a desire to operate in a cooperative mode and, in response to the input, selectively generating commands causing movements of both the first and second linkage arrangements based on only the first actuator signals.

DETAILED DESCRIPTION

Figure 1:
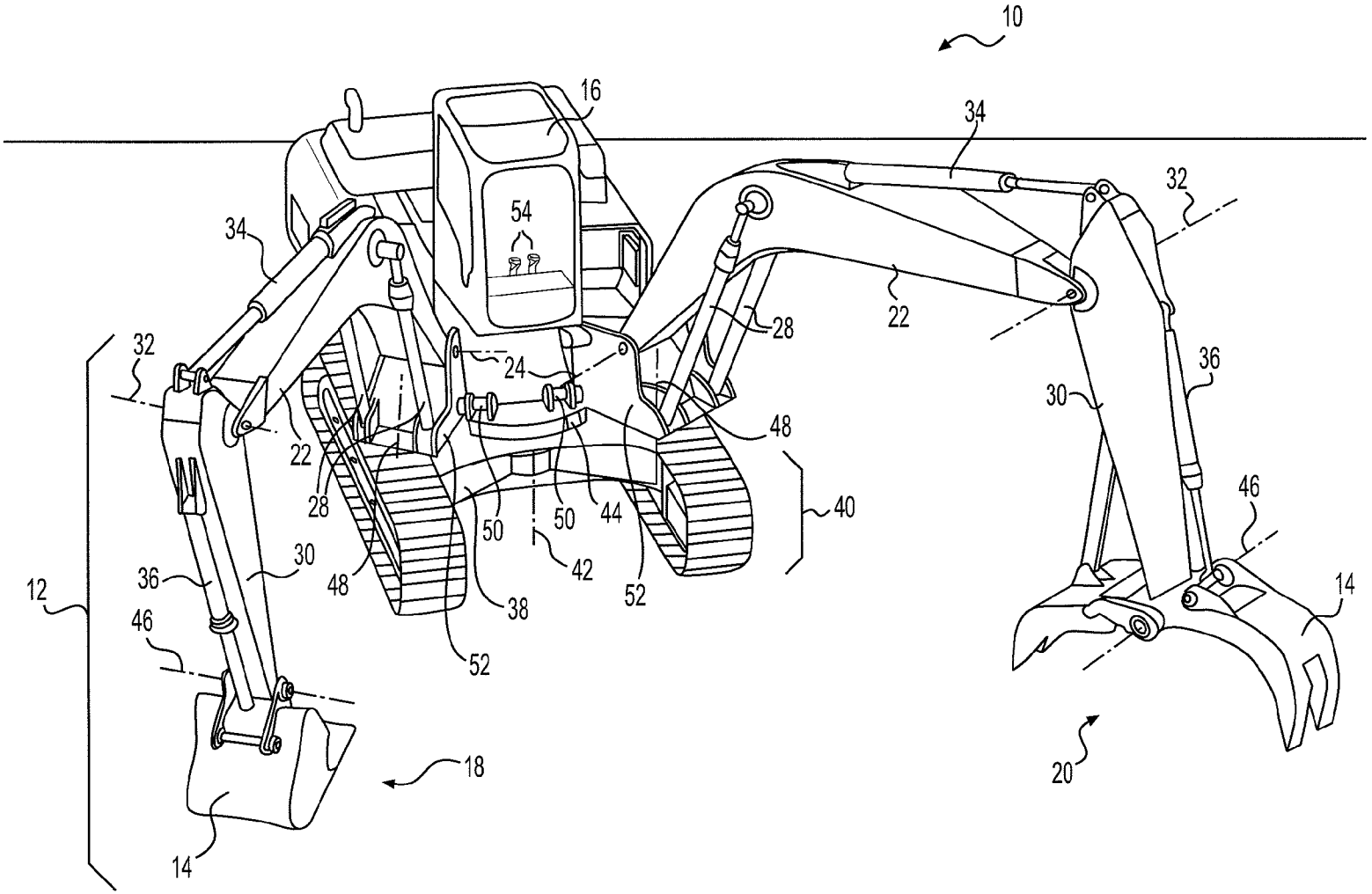
FIG. 1 is a diagrammatic illustration of an exemplary disclosed machine.
Figure 2:
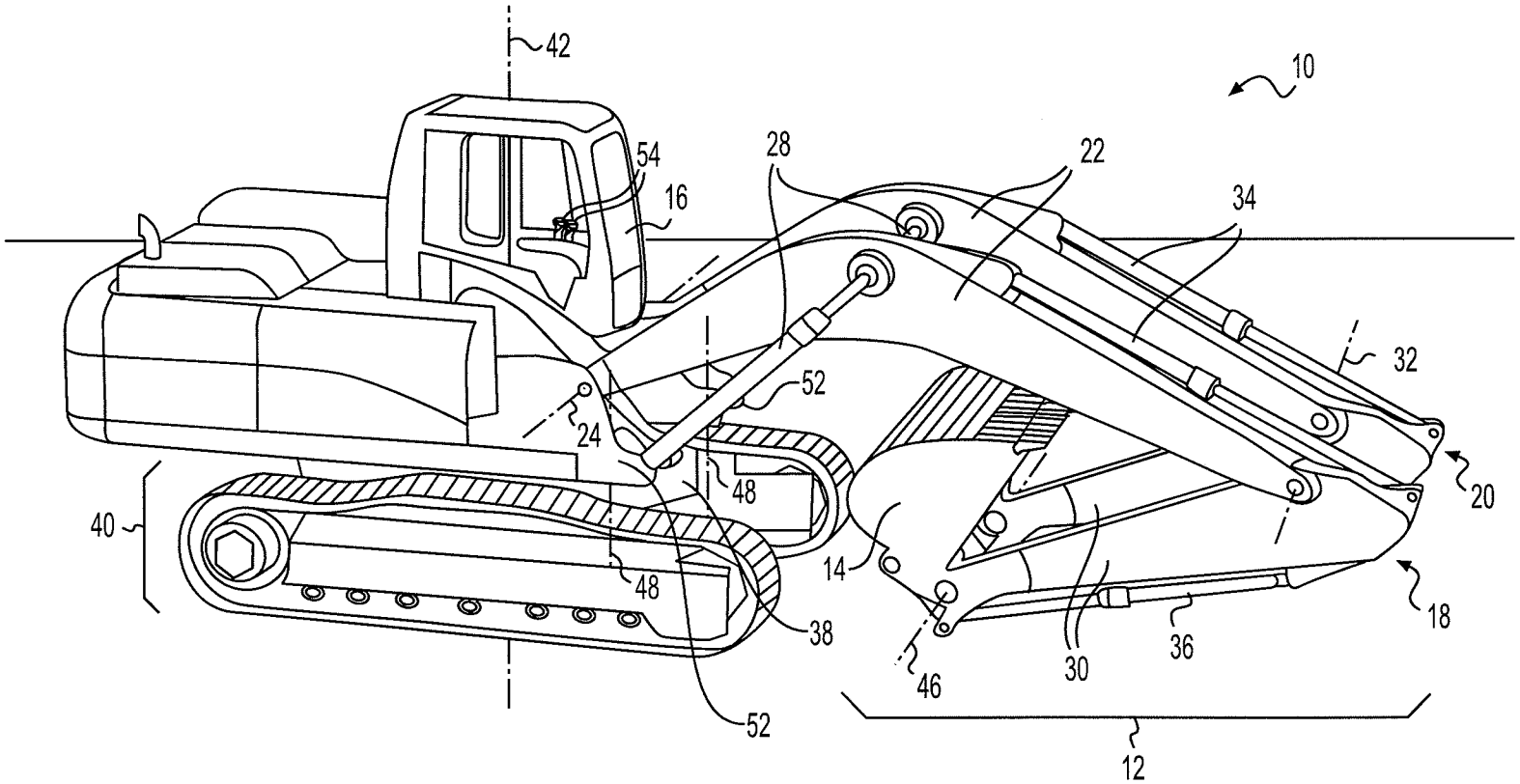
FIG. 2 is a diagrammatic illustration of another exemplary disclosed machine.

FIGS. 1 and 2 illustrate exemplary machines 10 each having multiple systems and components that cooperate to excavate, demolish, load, move, and/or otherwise process material (e.g., scrap metal, earthen material, landfill material, roadway debris, etc.). In the depicted examples, machines 10 are hydraulic excavators. It is contemplated, however, that machines 10 could alternatively embody other types of excavation or material handling machines, such as backhoes, front shovels, dragline shovels, cranes, or other similar machines. Machines 10 may each include, among other things, an implement system 12 that is configured to move one (see FIG. 2) or more (see FIG. 1) work tools 14 between different locations and/or to actuate work tools 14. Each machine 10 may also include an operator station 16 for manual control of implement system 12.

Implement system 12 may include two different linkage arrangements 18, 20 having associated fluid actuators that cooperate to move work tool(s) 14. In the disclosed embodiment, each linkage arrangement 18, 20 includes a boom 22 that is vertically pivotal about a horizontal pivot axis 24 relative to a work surface by a pair of adjacent, double-acting, hydraulic cylinders 28. Each linkage arrangement 18, 20 also includes an arm or stick 30 that is vertically pivotal about a horizontal pivot axis 32 relative to boom 22 by a single, double-acting, hydraulic cylinder 34. Linkage arrangements 18, 20 may each further include a single, double-acting, hydraulic cylinder 36 that is operatively connected to work tool 14 to tilt, open/close, or otherwise move work tool 14 relative to stick 30. Boom 22 may be pivotally connected to a frame 38 of machine 10, while frame 38 may be pivotally connected to an undercarriage 40 and swung about a vertical axis 42 by a swing motor 44. Stick 30 may pivotally connect work tool 14 to boom 22 by way of pivot axis 32 and another pivot axis 46. It is contemplated that a greater or lesser number of fluid actuators may be included within implement system 12, and/or connected in a manner other than described above, if desired.

In one exemplary embodiment, each linkage arrangement 18, 20 is further configured to pivot about a vertical axis 48 relative to frame 38. Specifically, an additional pivot cylinder 50 may be connected between frame 38 and a base 52 of each linkage arrangement 18, 20. Accordingly, boom 22 and the rest of each linkage arrangement 18, 20 may be configured to both pivot and swing in the horizontal direction relative to frame 38. Vertical axis 48 and pivot cylinder 50 may be omitted from some arrangements, as desired.

Numerous different work tools 14 may be attachable to a single machine 10 and controllable via operator station 16. Work tool 14 may include any device used to perform a particular task such as, for example, a bucket, a fork arrangement, a blade, a shovel, a crusher, a shear, a grapple, a magnet, a hammer, or any other task-performing device known in the art. In the embodiment of FIG. 1, two different work tools 14 are connected to implement system 12 (e.g., one work tool 14 to each of linkage arrangements 18, 20), while in the embodiment of FIG. 2, a single work tool 14 is simultaneously connected to both linkage arrangements 18, 20.

In embodiments where multiple work tools 14 are simultaneously used within implement system 12, the work tools 14 may be paired for use together. For example, the work tool 14 connected to linkage arrangement 18 may be a hammer or a shear configured to process material, while the paired work tool 14 connected to linkage arrangement 20 may be a bucket, a grapple, or a magnet configured to move the material before and/or after being processed. Although connected in the embodiment of FIG. 1 to lift, swing, pivot, tilt, curl, and open/close relative to machine 10, work tool(s) 14 may alternatively or additionally rotate, slide, extend, and/or move in another manner known in the art.

Operator station 16 may be configured to receive input from a machine operator indicative of desired work tool movements. Specifically, operator station 16 may include at least one interface device 54 associated with each linkage arrangement 18, 20. Each interface device 54 may embody, for example, as single or multi-axis joystick located near an operator seat (not shown). Interface devices 54 may be proportional-type controllers configured to position and/or orient work tools 14 by producing work tool position signals that are indicative of desired work tool speeds and/or forces in particular directions. The position signals may be used to simultaneously actuate any one or more of hydraulic cylinders 28, 34, 36, 50 and/or swing motor 44.

For example, tilting a particular interface device 54 fore and aft may generate a boom signal indicative of a desire to lower and raise a particular boom 22, respectively. Similarly, tilting the same or another interface device 54 left and right may generate a stick signal indicative of a desire to tilt the corresponding stick 30 in or out, respectively. Likewise, twisting the same or another interface device 54 may generate signals associated with pivoting the corresponding linkage arrangement 18, 20 about axis 48. A button (not shown) on interface device 54 may generate a tool signal indicative of a desire to move (e.g., to curl) or otherwise actuate (e.g., to open, close, initiate hammering, initiate shearing, etc.) work tool 14. It is contemplated that another interface device 54 (e.g., the pedal shown in FIG. 3) may be used to generate signals indicative of desired swinging of implement system 12 and frame 38 relative to undercarriage 40 (i.e., the pedal may be used to indicate desired actuation of swing motor 44).

Figure 3:
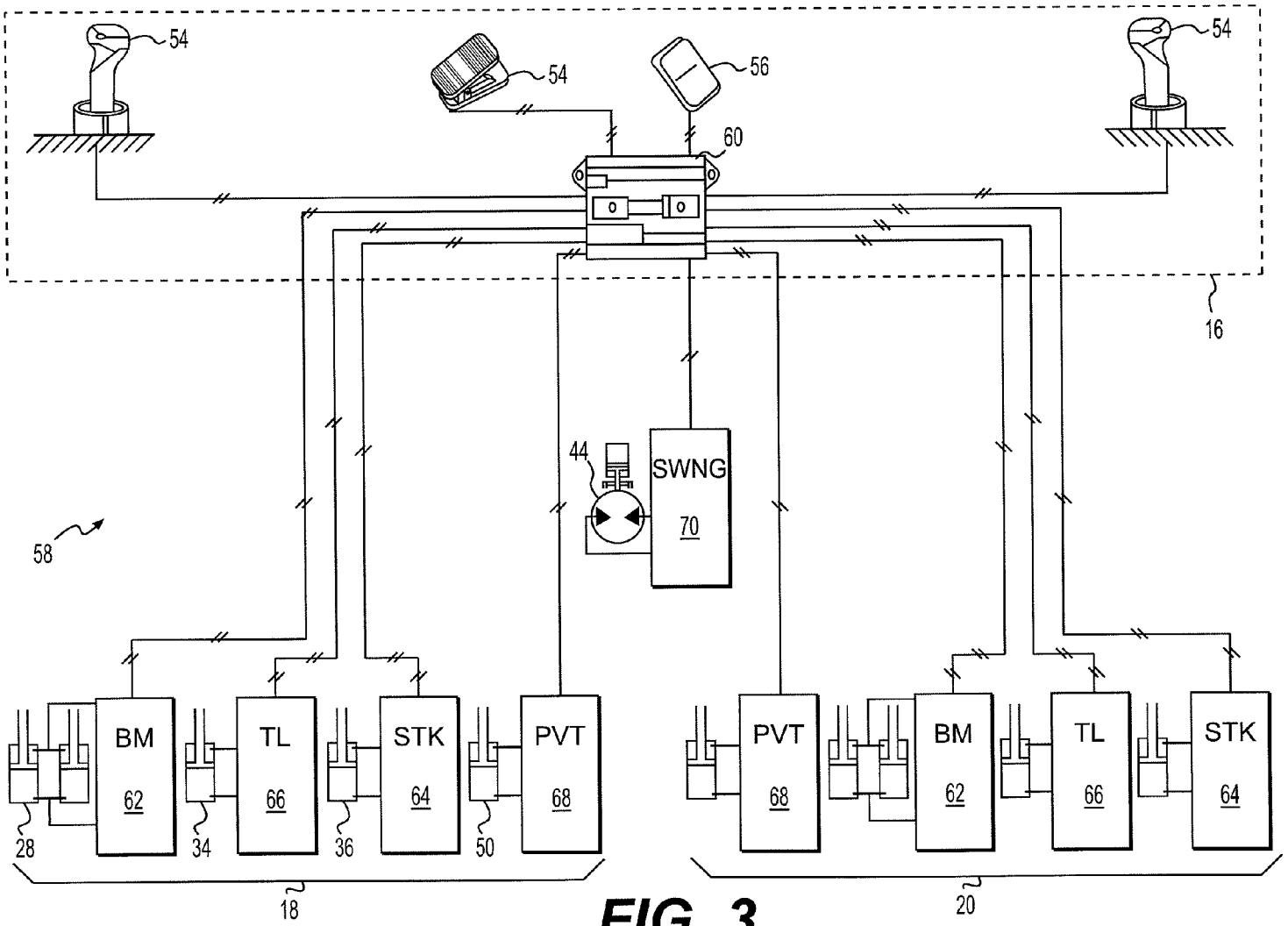
FIG. 3 is an exemplary disclosed control system that may be used with the machines of FIGS. 1 and 2.

Operator station 16 may also be configured to receive input from an operator indicative of a desired mode of operation. In particular, as shown in FIG. 3, a switch, button, or other input device 56 may be provided within operator station 16 that, when pressed or otherwise activated by the operator, provides input regarding the desired mode of operation. In the disclosed embodiments, the modes of operation may include a normal mode during which linkage arrangements 18, 20 are controlled independently based on actuator signals generated by the corresponding interface devices 54, and one or more cooperative modes of operation in which both linkage arrangements 18, 20 are selectively controlled together (e.g., dependently and/or simultaneously) based on actuator signals generated by only one of interface devices 54. As will be described in more detail below, the cooperative modes of operation may include a hoisting mode wherein both linkage arrangements 18, 20 work together to lift and move a common load, and/or a counterbalance mode wherein one linkage arrangement 18 automatically moves to counterbalance manually-requested movements of the other linkage arrangement 20, and vice versa. The cooperative modes of operation will be described in more detail below.

It is contemplated that additional and different interface and/or input devices may alternatively or additionally be included within operator station 16. These other devices may include, for example, wheels, knobs, push-pull devices, levers, touch screen displays, and other operator input devices known in the art. These additional devices may be used to request any particular movement of any actuator within implement system 12 and/or any mode of operation, as desired.

As illustrated in FIG. 3, machine 10 may include a control system 58 having a plurality of components that cooperate to move work tools 14 (referring to FIGS. 1 and 2) in response to the movements of interface devices 54 and manipulation of input device(s) 56. In particular, hydraulic control system 58 may include a controller 60 in communication with interface devices 54, input device 56, and various control valves responsible for regulating the motion of hydraulic cylinders 28, 34, 36, 50 and swing motor 44. The control valves may include, among others, two boom control valves 62, two stick control valves 64, two tool control valves 66, two pivot control valves 68, and a swing control valve 70. Controller 60 may be configured to selectively cause control valves 62-70 to affect movement of their corresponding actuators based on the signals generated by interface devices 54 and in response to the mode of operation selected by the operator via input device(s) 56.

Each of control valves 62-70 may regulate the motion of their related fluid actuators in response to commands generated by controller 60. Specifically, boom control valve 62 may have elements movable to control the motion of hydraulic cylinders 28 associated with boom 22; stick control valve 64 may have elements movable to control the motion of hydraulic cylinder 34 associated with stick 30; tool control valve 66 may have elements movable to control the motion of hydraulic cylinder 36 associated with work tool 14; and pivot control valve 68 may have elements movable to control the motion of hydraulic cylinder 50 associated with linkage base 52. Likewise, swing control valve 70 may have elements movable to control the swinging motion of hydraulic motor 44. The control elements of each of control valves 62-70 may selectively be caused to move and thereby allow pressurized fluid to flow to and drain from their respective actuators. This fluid flow into and out of the actuators may result in movement of the actuators at desired speeds and with desired forces in desired directions.

Because the elements of boom, stick, tool, pivot, and swing control valves 62-70 may be similar and function in a related manner, only the operation of boom control valve 62 will be discussed in this disclosure. In one example, boom control valve 62 may include a first chamber supply element (not shown), a first chamber drain element (not shown), a second chamber supply element (not shown), and a second chamber drain element (not shown). The first and second chamber supply elements may be connected in parallel with a fluid source (e.g., a pump—not shown), while the first and second chamber drain elements may be connected in parallel with a drain (e.g., a tank—not shown). To extend hydraulic cylinders 28, the first chamber supply element may be moved to allow the pressurized fluid from the source to fill the first chambers of hydraulic cylinders 28, while the second chamber drain element may be moved to drain fluid from the second chambers of hydraulic cylinders 28. To move hydraulic cylinders 28 in the opposite direction, the second chamber supply element may be moved to fill the second chambers of hydraulic cylinders 28 with pressurized fluid, while the first chamber drain element may be moved to drain fluid from the first chambers of hydraulic cylinders 28. It is contemplated that both the supply and drain functions may alternatively be performed by a single element associated with the first chamber and a single element associated with the second chamber, or by a single element that controls all filling and draining functions.

The supply and drain elements may be solenoid movable in response to a command from controller 60. In particular, hydraulic cylinders 28, 34, 36, 50 and swing motor 44 may move at velocities that correspond to the flow rates of fluid into and out of the first and second chambers. To achieve the operator-desired velocity and/or force indicated via the interface device position signal, a command based on an assumed or measured pressure may be sent to the solenoids (not shown) of the supply and drain elements that causes them to open an amount corresponding to the necessary flow rates and/or pressures. The command may be in the form of a flow rate command or a valve element position command generated by controller 60.

Controller 60 may embody a single microprocessor or multiple microprocessors that include a means for controlling an operation of control system 58. Numerous commercially available microprocessors can be configured to perform the functions of controller 60. It should be appreciated that controller 60 could readily be embodied in a general machine microprocessor capable of controlling numerous machine functions. Controller 60 may include a memory, a secondary storage device, a processor, and any other components for running an application. Various other circuits may be associated with controller 60 such as power supply circuitry, signal conditioning circuitry, solenoid driver circuitry, and other types of circuitry.

One or more maps relating the interface device position signals, the mode signal, desired actuator velocities, desired actuator forces, associated flow rates, and/or valve element positions for hydraulic cylinders 28, 34, 36, 50 and/or swing motor 44 may be stored in the memory of controller 60. Each of these maps may include a collection of data in the form of tables, graphs, and/or equations. Controller 60 may be configured to select specific maps from available relationship maps stored in the memory of controller 60, based on the mode signal, to affect fluid actuator motion in different ways.

Controller 60 may be configured to receive input from operator interface devices 54 and to command operation of control valves 62-70 in response to the input and the selected relationship maps described above. Specifically, controller 60 may receive an interface device position signal indicative of a desired velocity, and reference the selected relationship map from the maps stored in the memory of controller 60. Based on the selected map, controller 60 may determine flow rate values and/or associated positions for each of the supply and drain elements within particular control valves 62-70. The flow rates or positions may then be commanded of the appropriate supply and drain elements to cause filling of the first or second chambers at a rate that results in the desired work tool velocity and/or force in the desired direction.

INDUSTRIAL APPLICABILITY

The disclosed control system may be applicable to any machine having multiple linkage arrangements. The disclosed control system may provide a way to manually use the linkage arrangements separately and manually coordinate their use with each other, thereby improving machine efficiency. The disclosed system may also provide a way to automatically use the linkage arrangements together to enhance machine capacity and/or stability. Operation of control system 58 will now be described.

During the normal mode of operation, linkage arrangement 18 may be used completely independently of linkage arrangement 20. That is, as the operator manipulates a first interface device 54 (e.g., an interface device 54 located to the right of the operator), a request for a particular movement of the work tool 14 associated with linkage arrangement 18 may be created that causes controller 60 to activate select control valves 62-70 associated with only linkage arrangement 18. Likewise, as the operator manipulates a second interface device 54 (e.g., an interface device 54 located to the left of the operator), a request for a particular movement of the work tool 14 associated with linkage arrangement 20 may be created that causes controller 60 to activate select control valves 62-70 associated with only linkage arrangement 20. During the normal mode of operation, use of the first interface device 54 may not have a significant effect (if any) on movement of linkage arrangement 20 and, likewise, use of the second interface device 54 may not have a significant effect (if any) on movement of linkage arrangement 18. In this manner, the operator may use the different linkage arrangements 18, 20 to accomplish different tasks at the same time and in different manners.

When the operator presses input device 56, however, controller 60 may control linkage arrangements 18, 20 according to one of the cooperative modes of operation (e.g., either the hoisting mode or the counterbalance mode) described above. For example, during the hoisting mode of operation, both of linkage arrangement 18 and linkage arrangement 20 may be caused to perform similar movements based on inputs received via only the first interface device 54. Specifically, when the operator tilts the first interface device 54 forward, booms 22 of both linkage arrangements 18, 20 may lower at about the same speed, with about the same force, and/or by about the same amounts. Similarly, when the operator tilts the first interface device 54 to the right, sticks 30 of both linkage arrangements 18, 20 may tilt away from frame 38 at about the same speed, with about the same force, and/or by about the same amounts. This same functionality may exist with regard to curling movements of work tools 14 and/or pivoting movements initiated by hydraulic cylinders 50.

It should be noted that, during the hoisting mode of operation, work tools 14 may not need to be in the same position and/or orientation prior to entering the mode. That is, the operator may position linkage arrangement 18 at a first position and/or orientation and linkage arrangement 20 at a different position and/or orientation prior to activating input device 56. Thereafter, these spatial differences between linkage arrangements 18, 20 may be maintained (i.e., their relationships may be frozen) during ensuing cooperative movements.

During the hoisting mode of operation, the capacity (i.e., lifting capacity, digging capacity, craning capacity, etc.) of machine 10 may be essentially the same as the capacity of a similar machine having a single linkage arrangement. That is, the two separate linkage arrangements 18, 20 may combine their individual capacities to accomplish a single greater task. In the embodiment of FIG. 2, linkage arrangements 18, 20 are shown as being connected to a single bucket, and the movements of linkage arrangements 18, 20 may be synchronized by controller 60 to accomplish a single digging operation with greater force than could have been completed by either linkage arrangement 18, 20 alone. A similar craning operation may be facilitated during the hoisting mode.

It is contemplated that during the hoisting mode of operation, when both linkage arrangements 18, 20 are connected to a single work tool 14, a particular connection algorithm may be implemented by controller 60, if desired. For example, the operator may manually control each linkage arrangement 18, 20 to align with the common work tool 14 as closely as possible before pressing input device 56. Thereafter controller 60 may automatically move linkage arrangements 18, 20 to precise locations required to make the connection with work tool 14. After linkage arrangements 18, 20 are confirmed by controller 60 to be in the precise locations, only then may controller 60 enable the hoisting mode of operation. In some embodiments, controller 60 may need to communicate with one or more cylinder position sensors (not shown) to determine correct placement of linkage arrangements 18, 20. In addition, it may be beneficial to utilize a tool coupler capable of receiving pins from two different linkage arrangements to make the desired connections. After successfully connecting to a single work tool 14, the operator would be able to hoist, dig, or operate as with an otherwise standard one-boom machine.

During the counterbalance mode of operation, linkage arrangement 18 may be caused to perform an automated movement that counterbalances a manually-controlled movement of linkage arrangement 20, and vice versa. Specifically, when the operator tilts the first interface device 54 forward, boom 22 of linkage arrangement 20 may lower at a speed and/or a force that is generally proportional to the tilt angle of the first interface device 54. This movement of interface device 54 may generate a moment on frame 38 that causes a resultant tipping movement of machine 10 (e.g., of operation station 16, frame 38, and undercarriage 40). This resulting movement, if unaccounted for, could create instabilities that are annoying or uncomfortable for the operator, or that degrade machine footing, productivity, efficiency, and/or stability. For example, during a high-precision hoisting maneuver, any tipping of machine 10 could result in damage to the load being moved and/or to the surrounding environment.

During the counterbalance mode of operation, however, controller 60 may selectively control linkage arrangement 18 to automatically generate a moment on frame 38 that at least partially attenuates the moment created by linkage arrangement 20. For example, during the manually-controlled lowering of boom 22 of linkage arrangement 20, controller 60 may cause boom 22 of linkage arrangement 18 to automatically raise with a force of about the same magnitude in an opposing direction. In some cases, boom 22 of linkage arrangement 18 may raise with the same velocity as the boom lowering velocity of linkage arrangement 20 and thereby generate the opposing force. In other cases, however, boom 22 of linkage arrangement 18 may raise at a different velocity that accounts for a load difference between linkage arrangements 18, 20. In either situation, the net effect may be to reduce the overall moment acting on operator station 16, frame 38, and/or undercarriage 40, thereby increasing the stability of machine 10 during hoisting.

In some situations, rather than generating opposing movements to increase machine stability, controller 60 may instead cause linkage arrangement 18 to move in the same general manner as linkage arrangement 20, but on different sides of machine 10 to balance the corresponding moments. For example, when linkage arrangement 20 is pivoted to the right (i.e., away from linkage arrangement 18) and raised at its maximum velocity, a boom lowering movement of linkage arrangement 18 at the opposing side of machine 10 could actually increase the overall moment on machine 10. In this scenario it could be possible for machine 10 to tip excessively. Accordingly, in this situation, controller 60 may instead cause boom 22 to pivot to the left (i.e., away from linkage arrangement 18) and raise at a velocity corresponding to the raising velocity and/or load-based force of linkage arrangement 20. By doing so, the overall moment on machine 10 may be attenuated even though both movements are essentially the same (i.e., even though both movements are raising movements).

In yet other situations, it may be undesirable for one linkage arrangement to move automatically, for example in situations where other equipment or personnel are operating in close proximity. In these situations, during the counterbalance mode of operation, controller 60 may selectively cause the non-manually controlled linkage arrangement to act as a stationary anchor. For example, controller 60 (or the operator) may move the counterbalancing linkage arrangement to engage the ground surface and then to be frozen in place in the ground (or in the air) at a location that balances the manually controlled linkage arrangement. Thereafter, controller 60 may selectively activate the hydraulic actuators of the counterbalancing linkage arrangement such that it remains stationary regardless of other movements (e.g., swinging movements) of machine 10 that are being manually controlled.

Several benefits may be associated with the disclosed control system. For example, machine 10, being equipped with control system 58, may have about the same capacity as a similar machine having a single linkage arrangement, yet still have the versatility and improved productivity/efficiency associated with separate linkage arrangements. Further, the disclosed machine may benefit from improved capacity and stability during the hoisting and counter balance modes of operation.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims and their equivalents.

What is claimed is:

1. A control system, comprising:

a first linkage arrangement;

a first actuator configured to move the first linkage arrangement;

a first interface device configured to generate first actuator signals indicative of operator desired movements of the first actuator;

a second linkage arrangement;

a second actuator configured to move the second linkage arrangement;

a second interface device configured to generate second actuator signals indicative of operator desired movements of the second actuator;

an input device selectively activated by the operator to generate a mode signal indicative of a desire for the first actuator and the second actuator to be controlled cooperatively; and a controller in communication with the first interface device, the second interface device, and the input device, the controller configured to:

selectively generate commands to move the first actuator in response to only the first actuator signals;

selectively generate commands to move the second actuator in response to only the second actuator signals; and in response to the mode signal, selectively generate commands to move both the first actuator and the second actuator in response to only the first actuator signals.

2. The control system of claim 1, wherein the first and second linkage arrangements are substantially identical.

3. The control system of claim 2, further including:

a third actuator configured to move the first linkage arrangement; and a fourth actuator configured to move the second linkage arrangement;

wherein the controller is configured to:

selectively generate commands to move the first actuator and the third actuator in response to only the first actuator signals;

selectively generate commands to move the second actuator and the fourth actuator in response to only the second actuator signals; and in response to the mode signal, selectively generate commands to move the first actuator, the second actuator, the third actuator, and the fourth actuator in response to only the first actuator signals.

4. The control system of claim 3, wherein each of the first and second linkage arrangements includes:

a boom;

a stick pivotally connected to at a first end to the boom; and a tool connected to a second end of the stick.

5. The control system of claim 4, wherein:

the first actuator is one of a pair of first boom actuators configured to raise and lower the boom of the first linkage arrangement;

the second actuator is one of a pair of second boom actuators configured to raise and lower the boom of the second linkage arrangement;

the third actuator is a single first stick actuator configured to pivot the stick relative to the boom of the first linkage arrangement; and the fourth actuator is a single second stick actuator configured to pivot the stick relative to the boom of the second linkage arrangement.

6. The control system of claim 1 further comprising a first and a second control element, wherein:

each of the first actuator and the second actuator is a hydraulic cylinder; and the first and second control elements are valves configured to regulate fluid flow into and out of the hydraulic cylinders.

7. The control system of claim 1, wherein the controller is configured to selectively generate commands to cause the second actuator to counterbalance movements of the first actuator in response to only the first actuator signals and the mode signal.

8. The control system of claim 1, wherein the controller is configured to selectively generate commands to cause the second actuator to share loading of the first actuator in response to only the first actuator signals and the mode signal.

9. The control system of claim 8, wherein the movements of the second actuator are substantially identical to the movements of the first actuator.

10. The control system of claim 1, further including a common work tool, wherein the first and second linkage arrangements are simultaneously connected to the common work tool.

11. The control system of claim 1, further including a machine body, wherein the first and second linkage arrangements are connected to pivot in two directions relative to the machine body by the first and second actuators.

12. The control system of claim 11, further including:

an undercarriage;

a swing motor configured to swing the machine body relative to the undercarriage; and a third interface device movable to indicate a desire to activate the swing motor.

13. A method of controlling a machine having first and second linkage arrangements, the method comprising:

receiving first actuator signals from a first interface device indicative of desired movements of the first linkage arrangement;

selectively generating commands causing movements of only the first linkage arrangement in response to only the first actuator signals;

receiving second actuator signals from a second interface device indicative of desired movements of the second linkage arrangement;

selectively generating commands causing movements of only the second linkage arrangement in response to only the second actuator signals;

receiving input indicative of a desire to operate in a cooperative mode; and in response to the input, selectively generating commands causing movements of both the first and second linkage arrangements in response to only the first actuator signals.

14. The method of claim 13, wherein the first and second linkage arrangements are substantially identical.

15. The method of claim 14, wherein selectively generating commands causing movements of both the first and second linkage arrangements includes generating commands causing the second linkage arrangement to counterbalance movements of the first linkage arrangement.

16. The method of claim 14, wherein selectively generating commands causing movements of both the first and second linkage arrangements includes generating commands causing the second linkage arrangement to mimic movements and share loading of the first linkage arrangement.

17. The method of claim 14, wherein:

selectively generating commands causing movements of only the first linkage arrangement includes generating commands that affect fluid flow through one or more hydraulic actuators associated with the first linkage arrangement; and selectively generating commands causing movements of only the second linkage arrangement includes generating commands that affect fluid flow through one or more hydraulic actuators associated with the second linkage arrangement.

18. An excavator, comprising:

an undercarriage;

a machine body pivotally connected to the undercarriage;

a swing motor configured to swing the excavator relative to the undercarriage;

a first boom connected to pivot in two directions relative to the machine body;

a first stick pivotally connected at one end to the first boom;

a first plurality of hydraulic cylinders connected to move the first boom and the first stick;

a first interface device configured to generate first actuator signals indicative of operator desired movements of the first boom and first stick;

a second boom connected to pivot in two directions relative to the machine body;

a second stick pivotally connected at one end to the second boom;

a second plurality of hydraulic cylinders connected to move the second boom and the second stick;

a second interface device configured to generate second actuator signals indicative of operator desired movements of the second boom and second stick;

an input device selectively activated by the operator to generate a mode signal indicative of a desire for the first plurality of hydraulic cylinders and the second plurality of hydraulic cylinders to be controlled cooperatively; and a controller in communication with the first interface device, the first plurality of control valves, the second interface device, the second plurality of control valves, and the input device, the controller configured to:

selectively generate commands to move the first boom and the first stick in response to only the first actuator signals;

selectively generate commands to move the second boom and the second stick in response to only the second actuator signals; and in response to the mode signal, selectively generate commands to simultaneously move the first boom, the first stick, the second boom, and the second stick in response to only the first actuator signals.

19. The excavator of claim 18, wherein the controller is configured to selectively generate commands cause the second plurality of hydraulic cylinders to counterbalance movements of the first plurality of hydraulic in response to only the first actuator signals and the mode signal.

20. The excavator of claim 18, wherein the controller is configured to selectively generate commands cause the second plurality of hydraulic cylinders to make movements that mimic and share loading of the first plurality of hydraulic cylinders in response to only the first actuator signals and the mode signal.

* * * * *